US012612281B2

(12) United States Patent
Namiki

(10) Patent No.: US 12,612,281 B2
(45) Date of Patent: Apr. 28, 2026

(54) MEDIUM TRANSPORT DEVICE AND IMAGE READING APPARATUS

(71) Applicant: SEIKO EPSON CORPORATION, Tokyo (JP)

(72) Inventor: Masaki Namiki, Kitakyushu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 122 days.

(21) Appl. No.: 18/469,591

(22) Filed: Sep. 19, 2023

(65) Prior Publication Data

US 2024/0092605 A1 Mar. 21, 2024

(30) Foreign Application Priority Data

Sep. 21, 2022 (JP) ..... 2022-149941

(51) Int. Cl.

| | |
|---|---|
| ***B65H 31/20*** | (2006.01) |
| ***B65H 1/04*** | (2006.01) |
| ***B65H 31/02*** | (2006.01) |
| ***B65H 31/22*** | (2006.01) |

(52) U.S. Cl.
CPC ..... *B65H 31/02* (2013.01); *B65H 2801/39* (2013.01)

(58) Field of Classification Search
CPC ..... B65H 31/22; B65H 31/20; B65H 31/24; B65H 31/02; B65H 2402/46; B65H 2402/10; B65H 2402/60; B65H 2405/3311; B65H 2405/33115; B65H 2405/3312; B65H 2405/33125; B65H 2405/3321; B41J 13/106; G03G 15/6552
See application file for complete search history.

(56) References Cited

U.S. PATENT DOCUMENTS

| | | | | | |
|---|---|---|---|---|---|
| 5,141,222 | A * | 8/1992 | Sawada | B65H 39/11 271/302 |
| 5,162,845 | A * | 11/1992 | Ariyama | G03G 15/00 399/361 |
| 5,251,890 | A * | 10/1993 | Sasai | B65H 31/22 271/189 |
| 2019/0344594 | A1* | 11/2019 | Yoshida | B41J 13/106 |
| 2021/0101769 | A1* | 4/2021 | Kawasaki | B65H 31/24 |
| 2022/0169471 | A1 | 6/2022 | Nagai et al. | |

FOREIGN PATENT DOCUMENTS

| | | | |
|---|---|---|---|
| JP | 01145976 | A * | 6/1989 |
| JP | 09175714 | A * | 7/1997 |
| JP | 2002160863 | A * | 6/2002 |
| JP | 2022086579 | A | 6/2022 |

* cited by examiner

*Primary Examiner* — Luis A Gonzalez
(74) *Attorney, Agent, or Firm* — CHIP LAW GROUP

(57) ABSTRACT

The present disclosure includes a placement member including a discharge tray configured to receive a medium discharged by the discharge unit configured to discharge a medium. The placement member is attachable to and detachable from a lower portion of a device main body. The present disclosure includes a height adjustment member configured to be mountable between the placement member and the device main body. The present disclosure includes a first lock member configured to lock coupling between the device main body and the height adjustment member, and a second lock member configured to lock coupling between the height adjustment member and the placement member.

4 Claims, 10 Drawing Sheets

MEDIUM TRANSPORT DEVICE AND IMAGE READING APPARATUS

The present application is based on, and claims priority from JP Application Serial Number 2022-149941, filed Sep. 21, 2022, the disclosure of which is hereby incorporated by reference herein in its entirety.

BACKGROUND

1. Technical Field

The present disclosure relates to a medium transport device and an image reading apparatus.

2. Related Art

An example of this type of apparatus is disclosed in JP-A-2022-86579. JP-A-2022-86579 discloses a medium transport device including a placement portion on which a medium discharged to a lower portion of a device main body is placed.

In a structure in JP-A-2022-86579, in a case where a large number of media are transported and discharged with a discharge tray fixed to the device, when a limit number of media that can be placed is small, it is necessary for a user to remove the media from the discharge tray each time the limit number of media that can be placed is reached, and usability for the user is poor.

SUMMARY

In order to solve the problem described above, a medium transport device according to the present disclosure includes a discharge unit provided in a device main body and configured to discharge a medium, a placement member including a discharge tray configured to receive a medium discharged by the discharge unit, and configured to be attachable to and detachable from a lower portion of the device main body, and a height adjustment member configured to be mountable between the placement member and the device main body.

Further, an image reading apparatus according to the present disclosure includes a reading unit configured to read an image on a medium to be transported, and the medium transport device according to any one aspect of a first aspect to a fifth aspect described below.

DESCRIPTION OF EMBODIMENTS

Figure 1A:
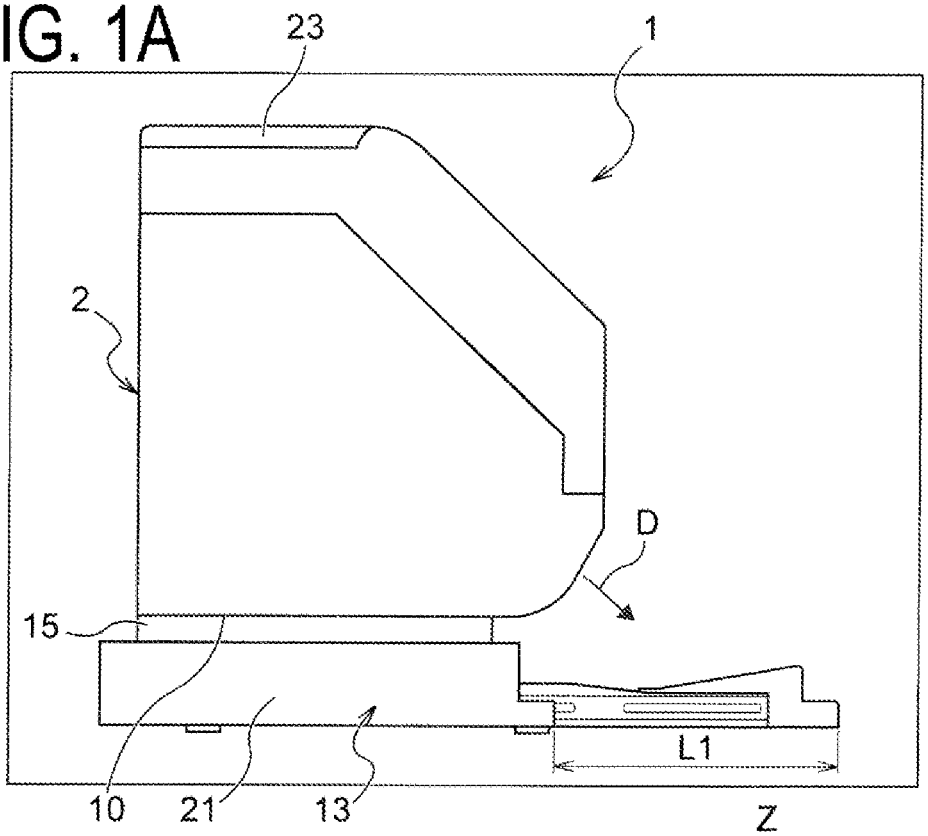
FIG. 1A and FIG. 1B are side views illustrating an image reading apparatus including a medium transport device according to a first embodiment.

Hereinafter, the present disclosure will be schematically described first.

In order to solve the problem described above, a medium transport device according to a first aspect of the present disclosure includes: a discharge unit provided in a device main body and configured to discharge a medium; a placement member including a discharge tray configured to receive a medium discharged by the discharge unit, and configured to be attachable to and detachable from a lower portion of the device main body; and a height adjustment member configured to be mountable between the placement member and the device main body.

According to the present aspect, the placement member is attachable to and detachable from the lower portion of the device main body, and the height adjustment member mountable between the placement member and the device main body is provided. In this way, by using the height adjustment member, a distance between the discharge unit and the discharge tray can be increased. Therefore, it is possible to increase the number of sheets placed in the discharge tray, and it is possible to improve usability for a user.

The medium transport device according to a second aspect of the present disclosure in the first aspect includes: a first lock member configured to lock coupling between the device main body and the height adjustment member; and a second lock member configured to lock coupling between the height adjustment member and the placement member.

According to the present aspect, the first lock member and the second lock member are provided. In this way, since the placement member or the device main body may not be displaced when the medium transport device is carried, it is possible to improve usability for a user.

In the medium transport device according to a third aspect of the present disclosure in the second aspect, the discharge tray can slide between a state in which the discharge tray is opened and a state in which the discharge tray is stored with respect to the placement member, and the second lock member is located in a storage portion in which the discharge tray is stored in the placement member.

According to the present aspect, since the second lock member is located in the storage portion in which the discharge tray is stored in the placement member, the second lock member can be provided by utilizing a space of the storage portion, and the entire device can be reduced in size.

In addition, when the discharge tray is slid with respect to the placement member, a portion of the second lock member is exposed so as to be accessible, and thus it is possible to improve usability for a user.

The medium transport device according to a fourth aspect of the present disclosure in the third aspect includes a feed tray provided in the device main body and on which a medium to be fed is placed, wherein the feed tray is opened from a storage state in which the feed tray is stored in the device main body to be in a posture that enables feeding of the medium, and, in a state in which the placement member is mounted downward of the device main body, the discharge tray slides from the placement member in association with the feed tray being opened from the device main body.

According to the present aspect, in the state in which the placement member is mounted at the device main body, the discharge tray slides from the placement member in association with the feed tray being opened from the device main body, and the discharge tray is brought into a state in which the discharge tray receives a medium discharged from the discharge unit. Thus, since the feed tray and the discharge tray move in association with each other, usability for a user is improved.

The medium transport device according to a fifth aspect of the present disclosure in any one aspect of the first aspect to the fourth aspect includes a second placement member configured to be attachable to and detachable from a lower portion of the device main body, wherein a second discharge tray included in the second placement member has a length in a direction in which the medium is discharged shorter than a length of the discharge tray.

According to the present aspect, since the second placement member dedicated to a short medium is provided, it is possible to appropriately use the placement member according to a length of the medium by using the second placement member.

An image reading apparatus according to a sixth aspect of the present disclosure includes: a reading unit configured to read an image on a medium to be transported; and the medium transport device according to any one aspect of the first aspect to the fifth aspect.

According to the present aspect, as the image reading apparatus, an action effect similar to that of the medium transport device in any aspect of the first aspect to the fifth aspect can be obtained.

EMBODIMENTS

Hereinafter, a medium transport device according to each embodiment of the present disclosure and an image reading apparatus including the medium transport device will be specifically described with reference to the drawings.

Description will be made with reference to the drawings in which three axes perpendicular to each other are set as the X-axis, the Y-axis, and the Z-axis. Directions indicated by arrows of the three axes (X, Y, and Z) are + directions of the respective directions, and opposite directions are − directions. The Z-axis direction corresponds to a vertical direction, that is, a direction in which gravity acts. The +Z direction indicates a vertical upward direction, and the −Z direction indicates a vertical downward direction. The X-axis direction and the Y-axis direction correspond to horizontal directions. The +Y direction indicates a front direction of the apparatus, and the −Y direction indicates a rear direction of the apparatus. The +X direction indicates a right direction of the apparatus, and the −X direction indicates a left direction of the apparatus.

First Embodiment

Overall Configuration of Image Reading Apparatus

An image reading apparatus 1 according to a first embodiment is a scanner capable of reading an image on a medium. Here, the image means what is visually recorded on the medium, and is, for example, a character, a figure, a table, a picture, a photograph, or the like. In addition, the medium is not limited to a sheet, and also includes a card, a booklet, and the like.

Figure 6:
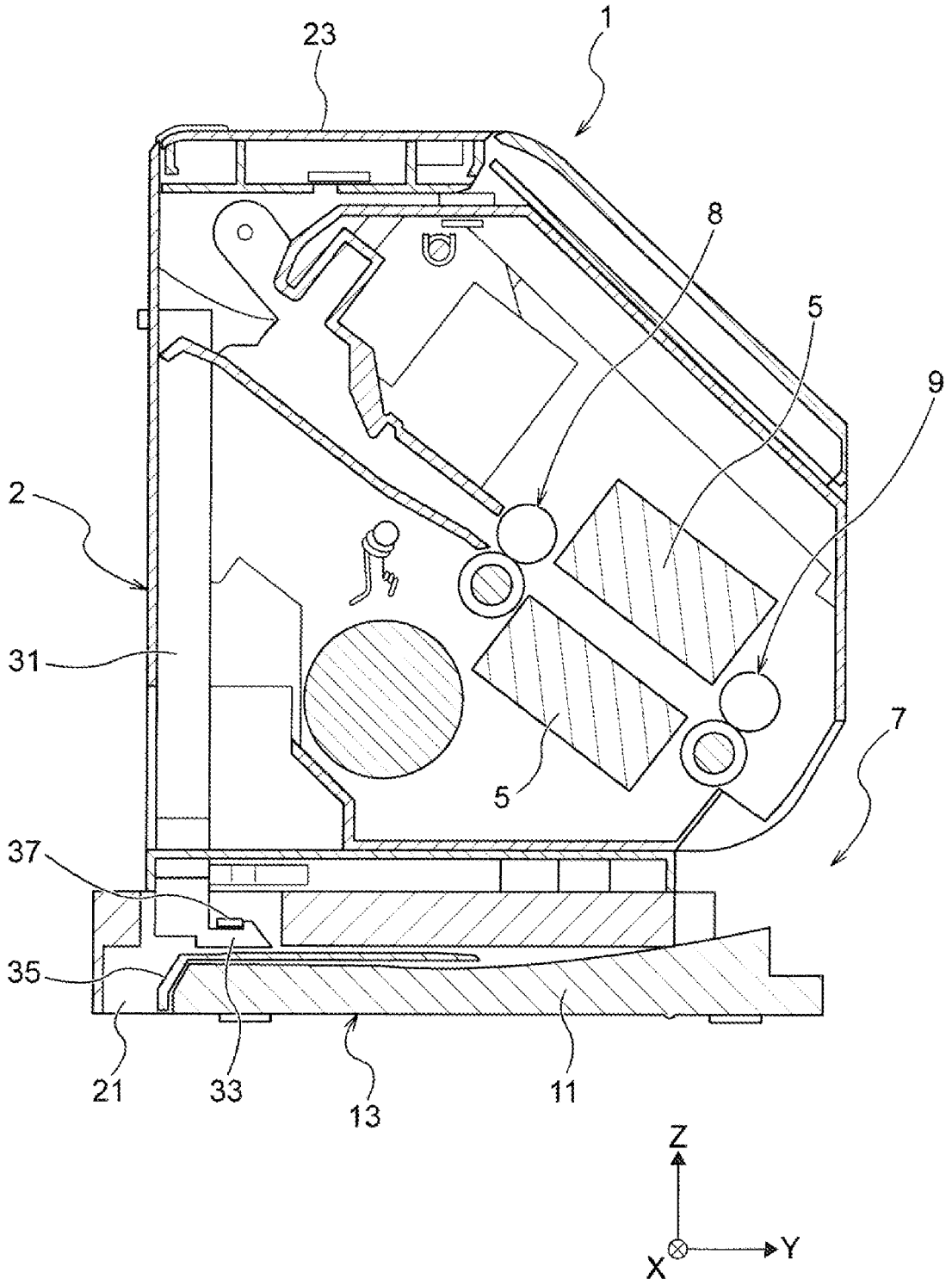
FIG. 6 is a side cross-sectional view illustrating an image reading apparatus according to a second embodiment.
Figure 7:
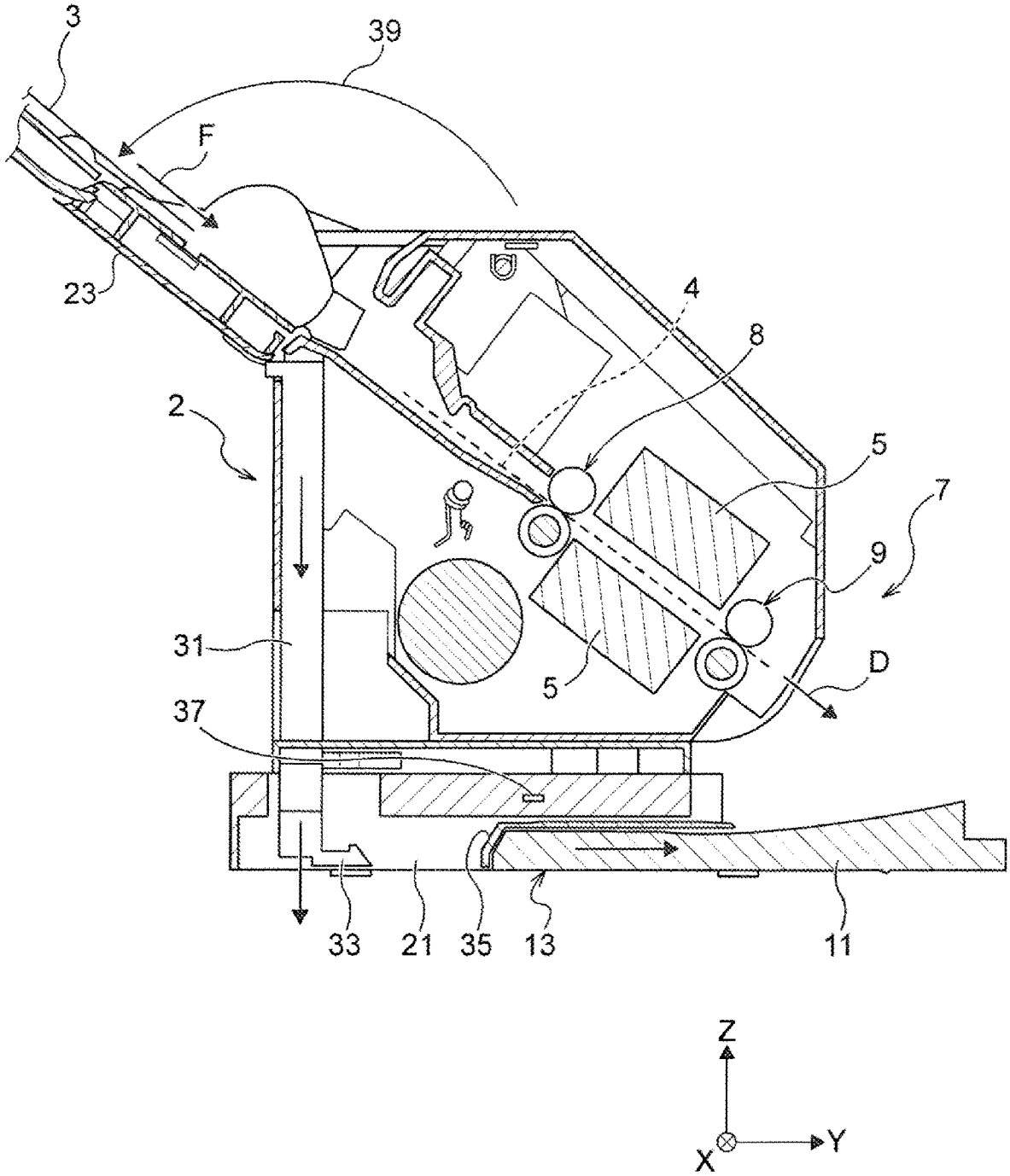
FIG. 7 is a side cross-sectional view illustrating the image reading apparatus according to the second embodiment.

As illustrated in FIGS. 1, 6, and 7, the image reading apparatus 1 includes a reading unit 5 capable of reading an image on a medium 3, and a medium transport device 7.

The medium transport device 7 includes a device main body 2, a discharge unit 9 that is provided in the device main body 2 and discharges the medium 3, a placement member 13 including a discharge tray 11 that receives the medium 3 discharged by the discharge unit 9, and a height adjustment member 15 (FIG. 1) described below.

In the device main body 2, other structural members such as a transport roller 8 (FIG. 7) that is provided upstream of the reading unit 5 in a transport path 4 and applies a transport force to the medium 3 are disposed in the same manner as in a normal scanner.

Note that, in this specification, the transport path 4 includes not only a portion on the upstream side of the discharge unit 9 but also a portion on the downstream side of the discharge unit 9, that is, a discharge path.

Medium Transport Device

As illustrated in FIGS. 1, 6, and 7, although a part is repeated description, the medium transport device 7 according to the present embodiment includes the discharge unit 9 that is provided in the device main body 2 and discharges, in a discharge direction D, the medium 3 transported in a transport direction F in the transport path 4 from the upstream side of the reading unit 5, and the placement member 13 including the discharge tray 11 that receives the medium 3 discharged by the discharge unit 9. The placement member 13 is configured to be attachable to and detachable from a lower portion of the device main body 2. The height adjustment member 15 mountable between the placement member 13 and a bottom surface 10 of the device main body 2 is provided.

Note that FIGS. 6 and 7 illustrate a state in which the height adjustment member 15 is not mounted at the device main body 2 and the placement member 13 is mounted at the bottom surface 10 of the device main body 2.

First Lock Member and Second Lock Member

In the present embodiment, a first lock member 17 that locks coupling between the device main body 2 and the height adjustment member 15, and a second lock member 19 that locks coupling between the height adjustment member 15 and the placement member 13 are provided.

Figure 2:
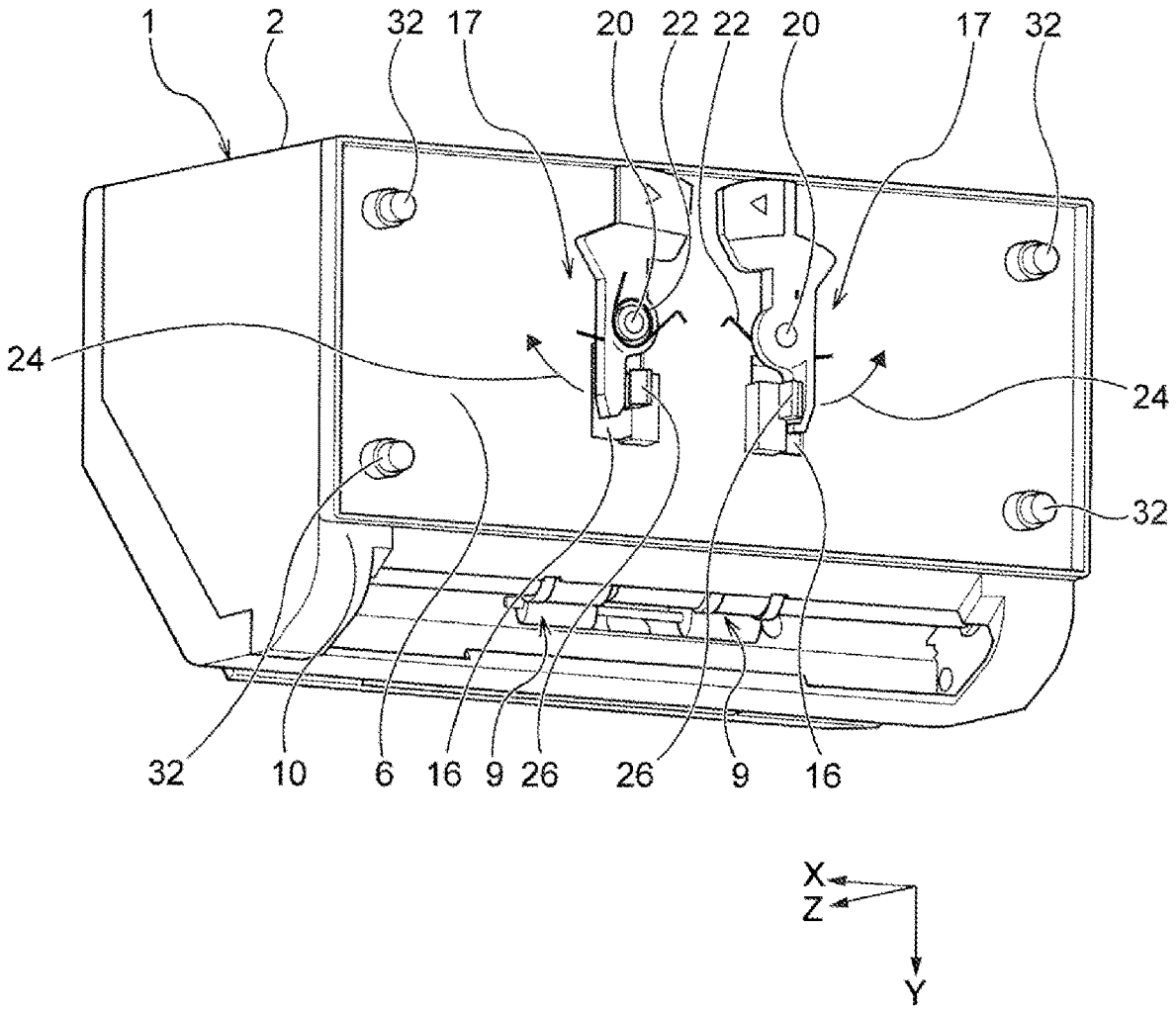
FIG. 2 is a perspective view illustrating the image reading apparatus according to the first embodiment when seen from below.
Figure 4:
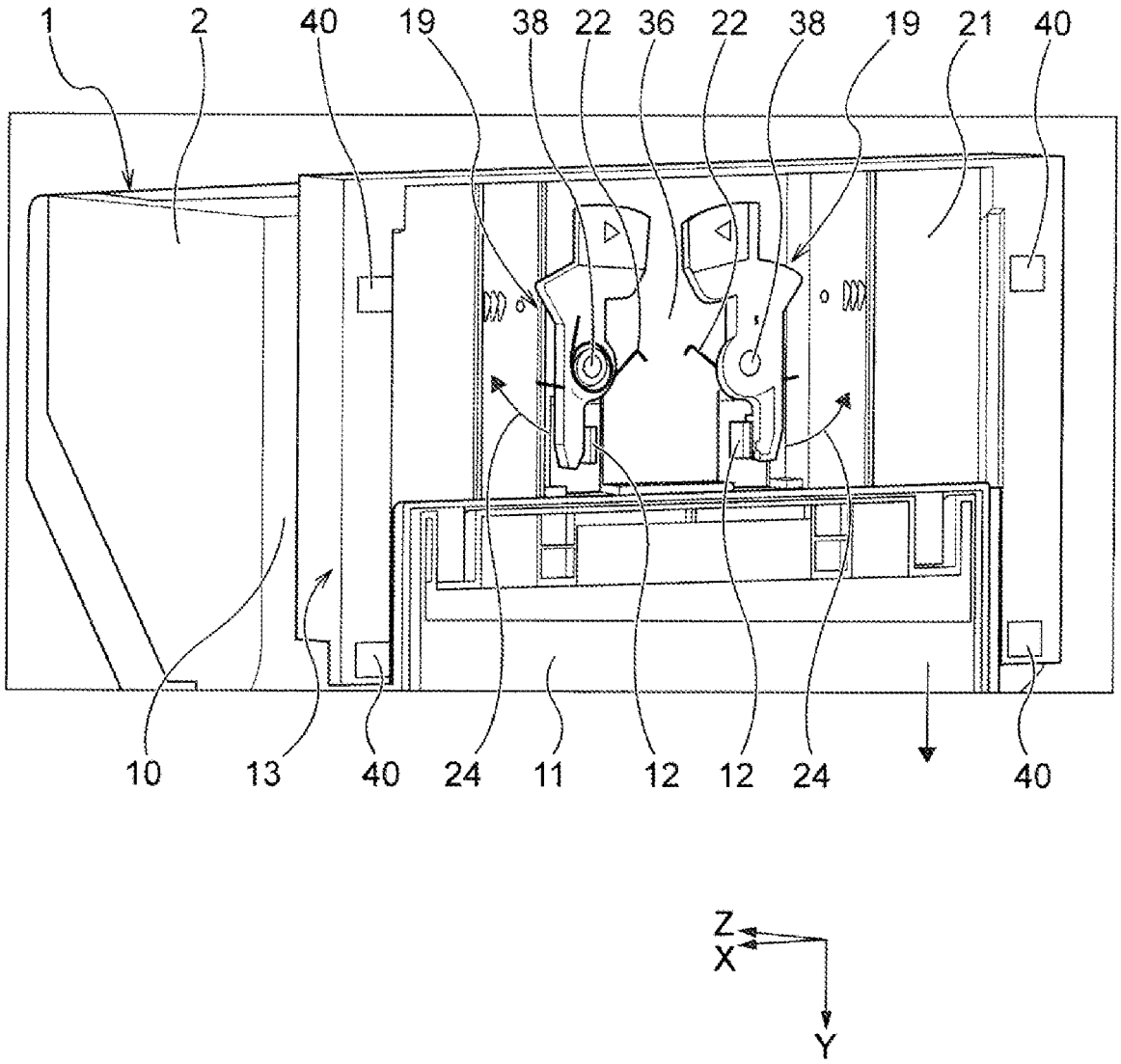
FIG. 4 is a perspective view of the image reading apparatus according to the first embodiment when seen from below.

As illustrated in FIGS. 2 and 5, in the present embodiment, two first lock members 17 are provided to be separated from each other in a width direction (X-axis direction) of the device main body 2. As illustrated in FIGS. 4 and 5, similarly, two second lock members 19 are provided to be separated from each other in the width direction (X-axis direction) of the device main body 2.

The first lock members 17, 17 are attached to a lower surface 6 of the height adjustment member 15, and include locked portions 14, 14 (FIG. 5B) that are locked to locking portions 18, 18 described below. Two hooks 12, 12 (FIG. 5) protrude downward (−Z direction) from the bottom surface 10 of the device main body 2. The height adjustment member 15 has holes 16, 16 formed in the vicinity of the locked portions 14, 14 of the first lock member 17. The hooks 12, 12 of the device main body 2 include the locking portions 18, 18 (FIG. 5B) that lock with the locked portions 14, 14.

Figure 3A:
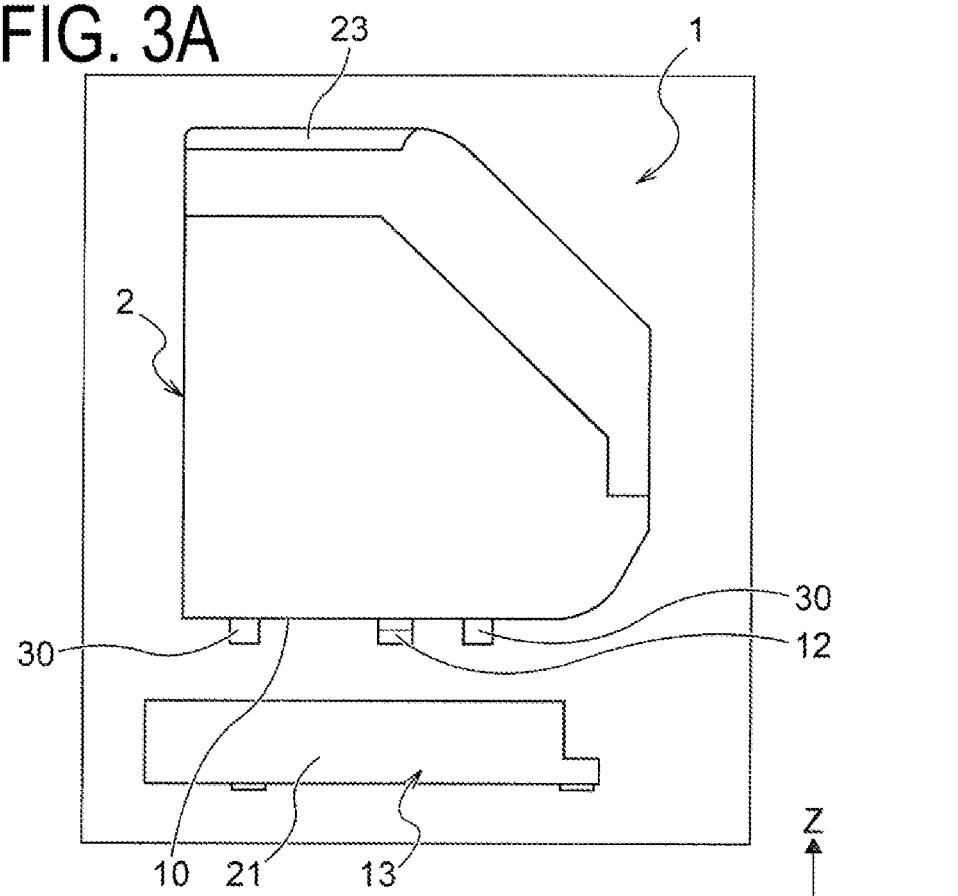
FIG. 3A and FIG. 3B are side views illustrating the image reading apparatus according to the first embodiment.

As illustrated in FIG. 3A, four positioning protrusions 30 protrude from the bottom surface 10 of the device main body 2. Since FIG. 3A is a side view, only two protrusions 30 of the four protrusions 30 are visible. The height adjustment member 15 is formed with four positioning holes (not illustrated) corresponding to the positioning protrusions 30.

As illustrated in FIG. 2, four positioning protrusions 32 also protrude from the lower surface 6 of the height adjustment member 15. The four positioning holes (not illustrated) formed in the placement member 13 are formed in positions corresponding to the positions of the four positioning protrusions 32.

In the present embodiment, as illustrated in FIGS. 2 and 5, two hooks 26, 26 are also formed at the lower surface 6 of the height adjustment member 15. The hooks 26, 26 are formed so as to be in the same position in the horizontal direction as the hooks 12, 12 via coupling portions 28, 28. In other words, the hooks 26, 26 are disposed so as to be located directly below the hooks 12, 12. In the present embodiment, the hooks 26, 26 are formed to have the same size and shape as those of the hooks 12, 12 except for the coupling portions 28, 28. Thus, the same parts are designated by the same reference numerals, and description will be omitted.

In FIG. 2, the hooks 12, 12 are hidden by the hooks 26, 26 and are invisible. In FIG. 5B, the hooks 26, 26 are not illustrated in order to avoid complication of the drawing.

As illustrated in FIG. 2, the first lock members 17, 17 are rotatably mounted at shafts 20, 20. Torsion coil springs 22, 22 are compressed between the shafts 20, 20 and the first lock members 17, 17. The torsion coil springs 22, 22 are configured to bias the locked portions 14, 14 by an elastic force in a direction toward a locking position where the locked portions 14, 14 are locked to the locking portions 18, 18, and to hold the locked portions 14, 14 in the locking position.

Mounting and Locking of Height Adjustment Member to Device Main Body

The device main body 2 and the height adjustment member 15 are positioned by the four positioning protrusions 30 and the four positioning holes, and the hooks 12, 12 of the device main body 2 penetrate the holes 16, 16 of the height adjustment member 15. In this way, the locked portions 14, 14 of the first lock member 17 are guided by inclined surfaces 34, 34 of the locking portions 18, 18 and are retracted from the locking position against the elastic force. When further moving in the penetration direction, the locking portions 18, 18 go beyond the inclined surfaces 34, 34. The locked portions 14, 14 return to the locking position by the elastic force of the torsion coil springs 22, 22. In this way, the locking portions 18, 18 of the hooks 12, 12 are locked with the locked portions 14, 14 of the first lock member 17. By the locking, the height adjustment member 15 is coupled to the bottom surface 10 of the device main body 2 in a state of being locked by the first lock members 17, 17.

In the locked state of FIG. 5, when the first lock member 17 is rotated in a direction of an arrow 24 against the elastic force, the locked portions 14, 14 are disengaged from the locking portions 18, 18. In this way, the locked state is released, and the height adjustment member 15 can be removed from the device main body 2.

Next, the second lock members 19, 19 will be described.

Figure 5A:
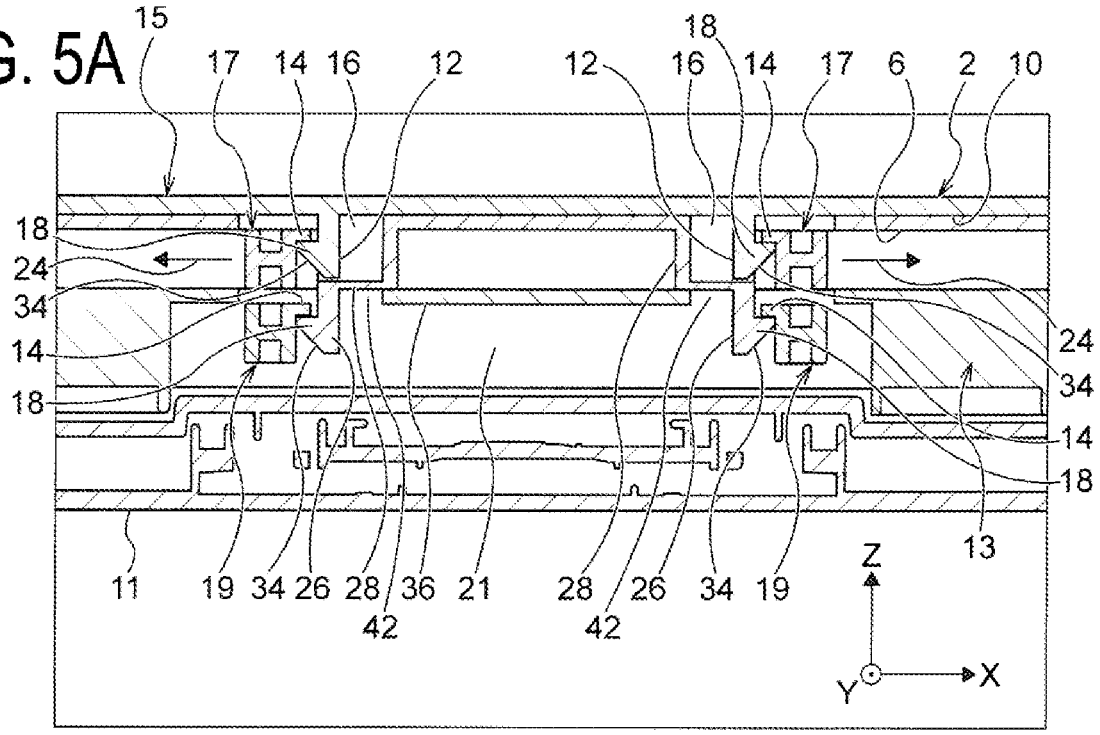
FIG. 5A and FIG. 5B are a cross-sectional view of a main part and a perspective view of a main part of the medium transport device according to the first embodiment.
Figure 5B:
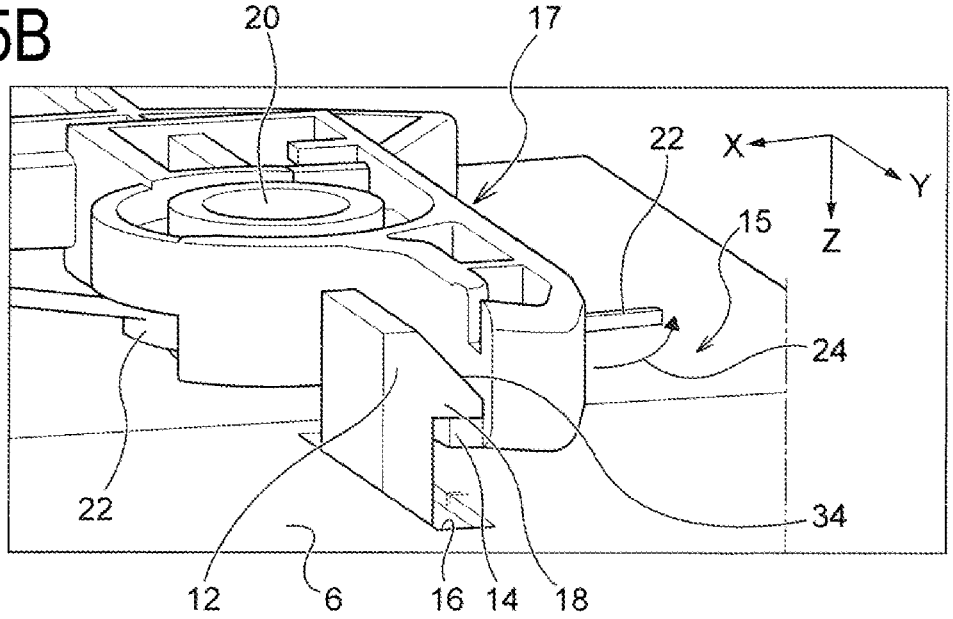

As illustrated in FIGS. 4 and 5A, the second lock members 19, 19 are attached to shafts 38, 38 of a lower surface 36 of the placement member 13. Note that, in FIG. 5A, the shafts 38, 38 are not illustrated. The second lock members 19, 19 have the same structure as that of the first lock members 17, 17. Thus, the same parts are designated by the same reference numerals, and description will be omitted.

As illustrated in FIG. 5A, the placement member 13 has holes 42, 42 formed in the vicinity of the locked portions 14, 14 of the second lock member 19. The placement member 13 is formed with four positioning holes (not illustrated) corresponding to the positioning protrusions 32. The four positioning holes (not illustrated) formed in the placement member 13 are formed in positions corresponding to the four positions provided with a reference sign 40 in FIG. 4.

Mounting and Locking of Placement Member to Height Adjustment Member

The height adjustment member 15 and the placement member 13 are positioned by the positioning protrusions 32 and the positioning holes, and the hooks 26, 26 of the height adjustment member 15 penetrate the holes 42, 42 of the placement member 13. In this way, the locked portions 14, 14 of the second lock member 19 are guided by the inclined surfaces 34, 34 of the locking portions 18, 18 and are retracted from the locking position against the elastic force. When further moving in the penetration direction, the locking portions 18, 18 go beyond the inclined surfaces 34, 34. The locked portions 14, 14 return to the locking position by the elastic force of the torsion coil springs 22, 22. In this way, the locking portions 18, 18 of the hooks 26, 26 are locked with the locked portions 14, 14 of the second lock member 19. By the locking, the placement member 13 is coupled to the bottom surface 6 of the height adjustment member 15 in a state of being locked by the second lock members 19, 19.

The unlocking is performed in the same manner as the first lock members 17, 17, and thus description thereof will be omitted.

Slide Movement

In the present embodiment, the medium transport device 7 is configured such that the discharge tray 11 slides from a storage state (FIG. 6) in which the discharge tray 11 is stored in the placement member 13 to be brought into a state (FIG. 7) in which the discharge tray 11 receives the medium 3 discharged from the discharge unit 9. The placement member 13 includes a storage portion 21 that stores the discharge tray 11 therein.

As illustrated in FIG. 5A, the second lock member 19 is configured to be located in a space of the storage portion 21 in which the discharge tray 11 is stored in the placement member 13.

Second Placement Member

In the present embodiment, the medium transport device 7 includes a second placement member 25 that is attachable to and detachable from the lower portion of the device main body 2. The second placement member 25 includes a second discharge tray 27. The second discharge tray 27 has a structure in which a length in a direction in which the medium 3 is discharged is shorter than that of the discharge tray 11.

Figure 1B:
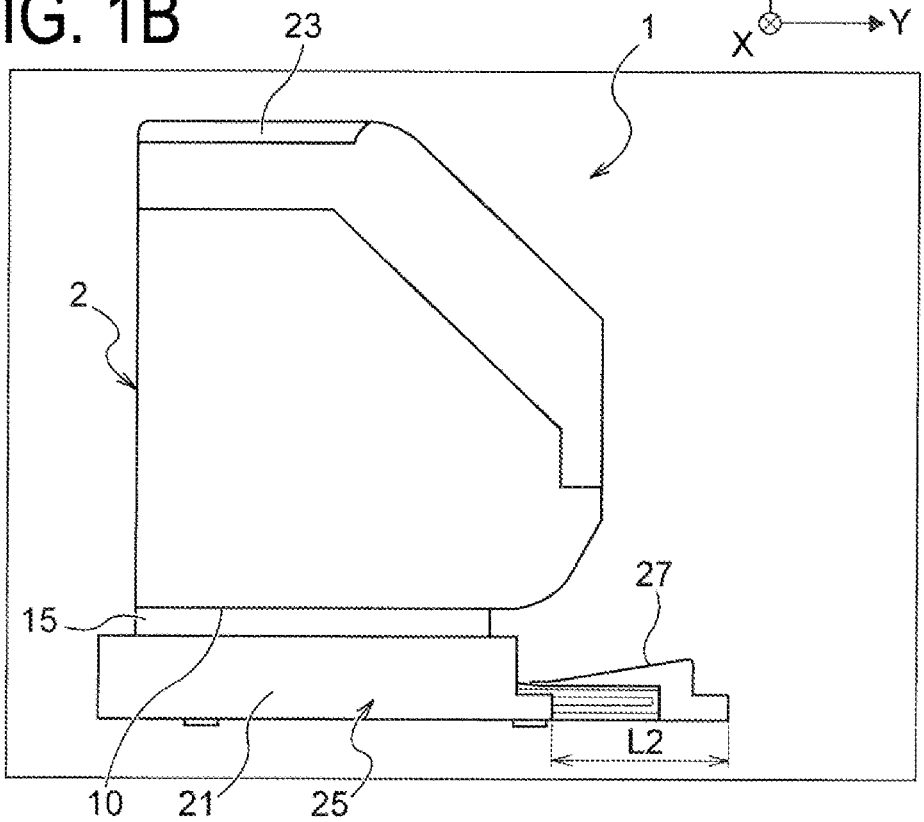

When the second placement member 25 is used, the placement member 13 in the state illustrated in FIG. 1A is removed from the height adjustment member 15. Then, the second placement member 25 is attached to the height adjustment member 15 instead, and the state illustrated in FIG. 1B is obtained.

Description of Actions of First Embodiment

Figure 3B:
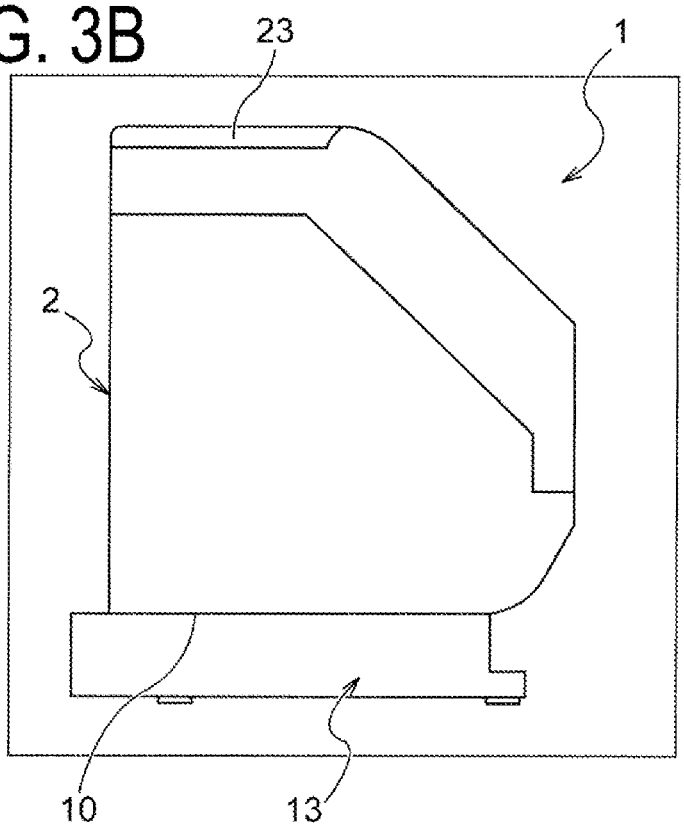

In the state illustrated in FIGS. 3B and 6, the placement member 13 is directly mounted at the device main body 2. In this state, as illustrated in FIG. 4, the discharge tray 11 is slid forward (+Y direction) to expose a portion of the second lock members 19, 19. Next, the second lock members 19, 19 are operated as described in the above description to change to an unlocked state. In this way, as illustrated in FIG. 3A, the device main body 2 can be separated from the placement member 13.

Next, the height adjustment member 15 is mounted at the bottom surface 10 of the device main body 2. This attachment is completed by operating the first lock members 17, 17 as described in the above description to bring it into the locked state. FIG. 2 corresponds to this state.

Furthermore, the placement member 13 is mounted at the lower surface 6 of the height adjustment member 15. This attachment is completed by operating the second lock members 19, 19 as described in the above description to bring it into the locked state. FIG. 1 corresponds to this state.

Description of Effects of First Embodiment (1) In the first embodiment, the placement member 13 is attachable to and detachable from the lower portion of the device main body 2, and the height adjustment member 15 mountable between the placement member 13 and the device main body 2 is provided. In this way, by using the height adjustment member 15, a distance between the discharge unit 9 and the discharge tray 11 can be increased. Therefore, it is possible to increase the number of sheets placed in the discharge tray 11, and it is possible to improve usability for a user.

(2) Further, in the present embodiment, the first lock members 17, 17 and the second lock members 19, 19 are provided. In this way, since the placement member 14 or the device main body 2 may not be displaced when the medium transport device 7 is carried, it is possible to improve usability for a user.

(3) Further, in the present embodiment, the second lock members 19, 19 are located in the storage portion 21 in which the discharge tray 11 is stored in the placement member 13. In this way, the second lock members 19, 19 can be provided by utilizing the space of the storage portion 21, and the entire device can be reduced in size.

In addition, when the discharge tray 11 is slid with respect to the placement member 13, a portion of the second lock members 19, 19 are exposed so as to be accessible, and thus it is possible to improve usability for a user.

(4) Further, in the present embodiment, since the second placement member 27 dedicated to a short medium is provided, it is possible to appropriately use the placement member according to a length of the medium 3 by using the second placement member 27.

Second Embodiment

Figure 8A:
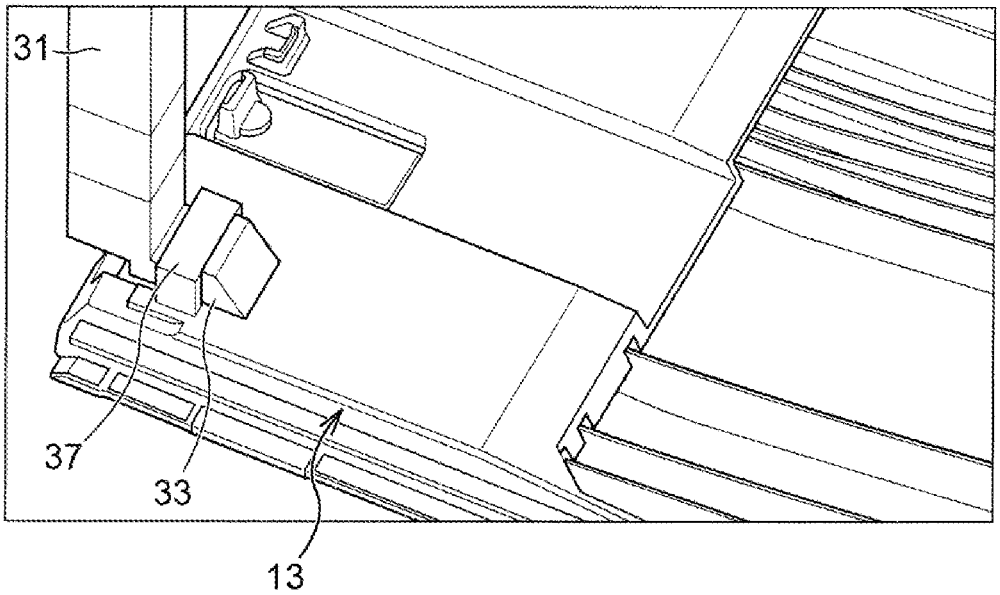
FIG. 8A and FIG. 8B are perspective views of a main part of the image reading apparatus according to the second embodiment.
Figure 8A:
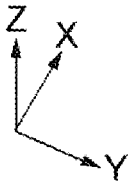
Figure 8B:
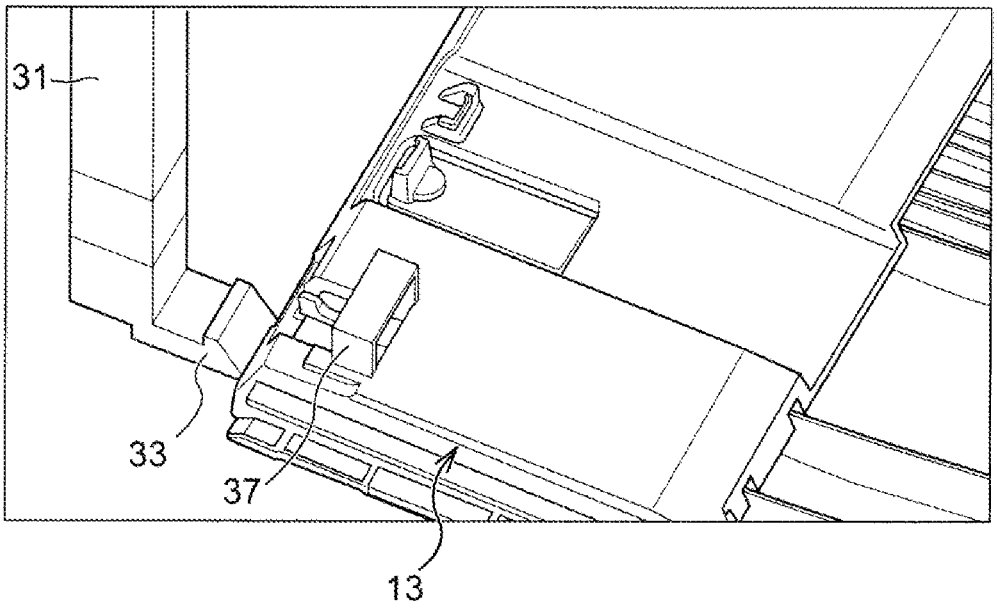

Hereinafter, a medium transport device 7 according to a second embodiment and an image reading apparatus 1 including the medium transport device 7 will be described with reference to FIGS. 6 to 8. The same parts as those in the first embodiment are designated by the same reference numerals, and description of the configurations and the effects will be omitted.

As illustrated in FIGS. 6 and 7, in the present embodiment, the medium transport device 7 is provided in a device main body 2 and includes a feed tray 23 on which a medium 3 to be fed is placed. The feed tray 23 is configured to be opened from the storage state (FIG. 6) in which the feed tray 23 is stored in the device main body 2 to be in a posture in which the medium 3 illustrated in FIG. 7 can be fed. The feed tray 23 is opened by pivoting along an arrow 39 about a shaft (not illustrated) serving as a pivot point.

In the present embodiment, in a state in which a placement member 13 is mounted downward of the device main body 2, a discharge tray 11 slides from the placement member 13 in association with the feed tray 23 being opened from the device main body 2. By this sliding movement, the discharge tray 11 is brought into a state in which the medium 3 discharged from a discharge unit 9 can be received.

Next, an interlocking structure 1 in which the feed tray 23 and the discharge tray 11 are interlocked with each other will be described with reference to FIGS. 6 to 8.

A lever 31 is provided in a longitudinal direction along a rear surface of the device main body 2. The lever 31 is biased upward by a biasing member such as a spring (not illustrated). The lever 31 is provided with an L-shaped hook 33 at its lower end, and as illustrated in FIG. 8A, the L-shaped hook 33 is locked to a hooked portion 37 provided at the placement member 13 and is held in that position against the biasing force (the state in FIG. 6).

When the feed tray 23 is pivoted along the arrow 39 to be opened, a part of the feed tray 23 comes into contact with the lever 31 and further pushes the lever 31 downward. When the lever 31 moves downward, the L-shaped hook 33 pushes a rear end portion 35 of the discharge tray 11 forward while disengaging from the hooked portion 37. In this way, the lever 31 moves downward from the position illustrated in FIGS. 6 and 8A to the position illustrated in FIGS. 7 and 8B and is held in that position.

The discharge tray 11 slides to a position for receiving the medium 3 by being pushed by the L-shaped hook 33.

When the discharge tray 11 in the state of FIG. 7 is returned into a storage portion 21 of the placement member 13, the feed tray 23 is returned to the storage state of FIG. 6. In this way, the lever 31 moves upward by the biasing force and stops in a position being a top dead point in FIG. 6. In this state, when the discharge tray 11 is pushed back into the storage portion 21 of the placement member 13, the L-shaped hook 33 is locked to the hooked portion 37 and held in that position.

Modification 1 of Interlocking Structure

Figure 9A:
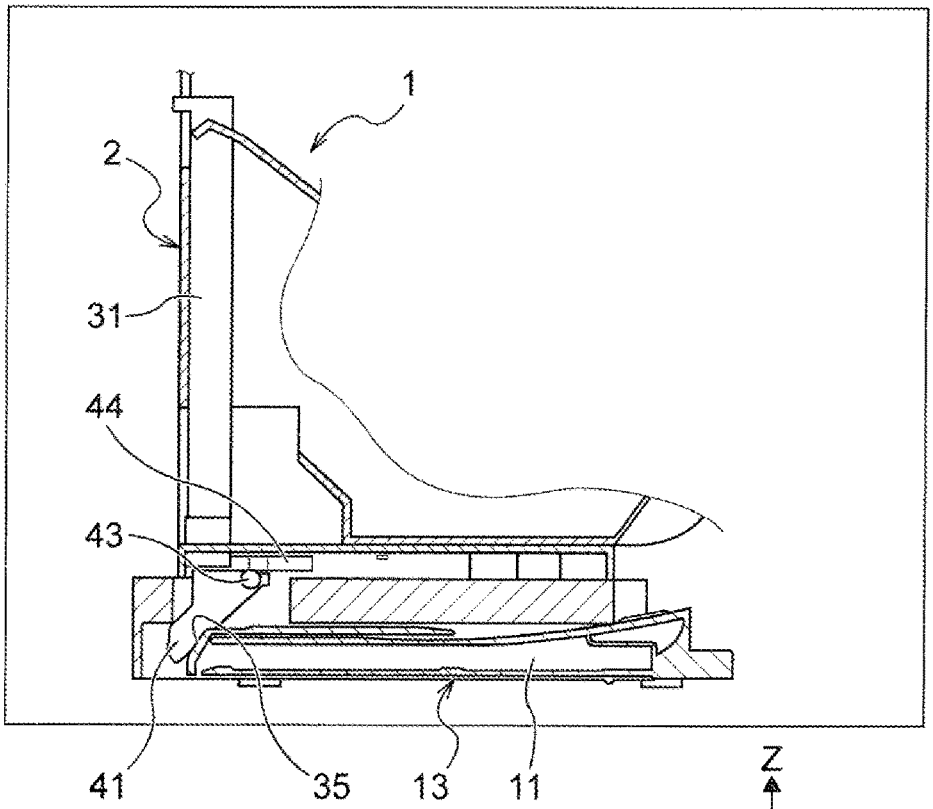
FIG. 9 is a side cross-sectional view of a main part in a first modified example of the second embodiment.
Figure 9A:
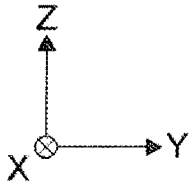

Next, another interlocking structure 2 in which the feed tray 23 and the discharge tray 11 are interlocked with each other will be described with reference to FIGS. 9A and 9B.

In the interlocking structure 2, a rotary cam 41 is provided below the lever 31. The rotary cam 41 is rotatably attached to a shaft 43. When the lever 31 moves downward from the state of FIG. 9A against the biasing force, the rotary cam 41 rotates about the shaft 43 as a rotation fulcrum, and a free end side pushes the rear end portion 35 of the discharge tray 11 forward (+Y direction). In this way, as illustrated in FIG. 9B, the rear end portion 35 of the discharge tray 11 is pushed by the rotary cam 41, and thus the discharge tray 11 slides to a position where the discharge tray 11 receives the medium 3.

Figure 9B:
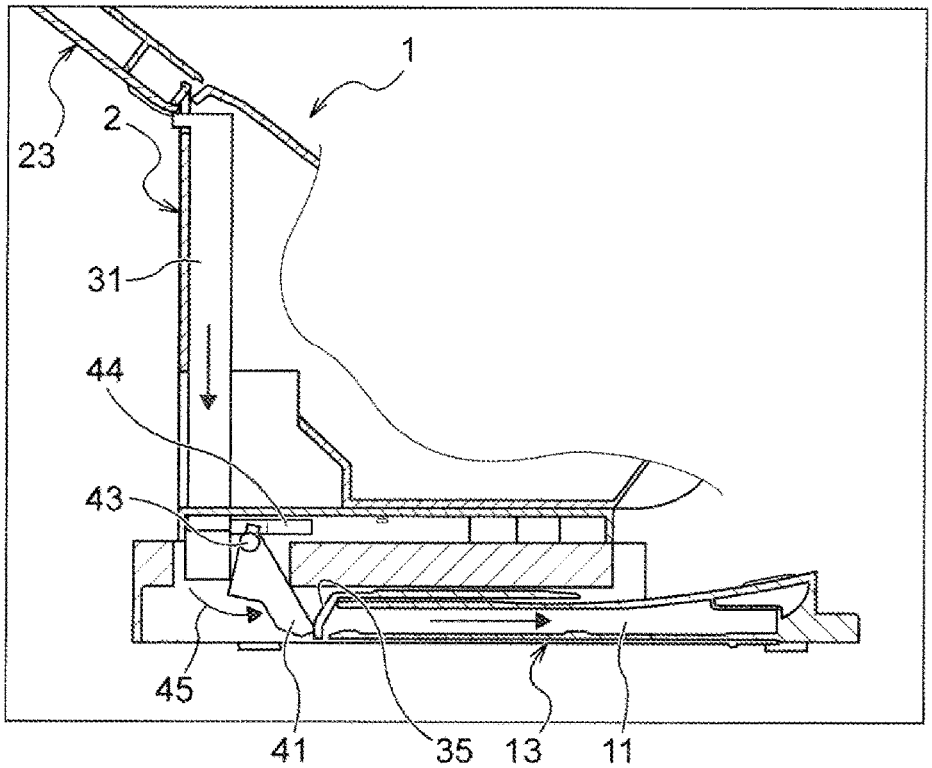

When the discharge tray 11 in the state of FIG. 9B is returned into the storage portion 21 of the placement member 13, the feed tray 23 is returned to the storage state. In this way, the lever 31 moves upward by the biasing force and stops in a position being a top dead point in FIG. 9A. In this state, when the discharge tray 11 is pushed back into the storage portion 21 of the placement member 13, the discharge tray 11 is brought into the state in FIG. 9A and held in that position.

Modification 2 of Interlocking Structure

Figure 10A:
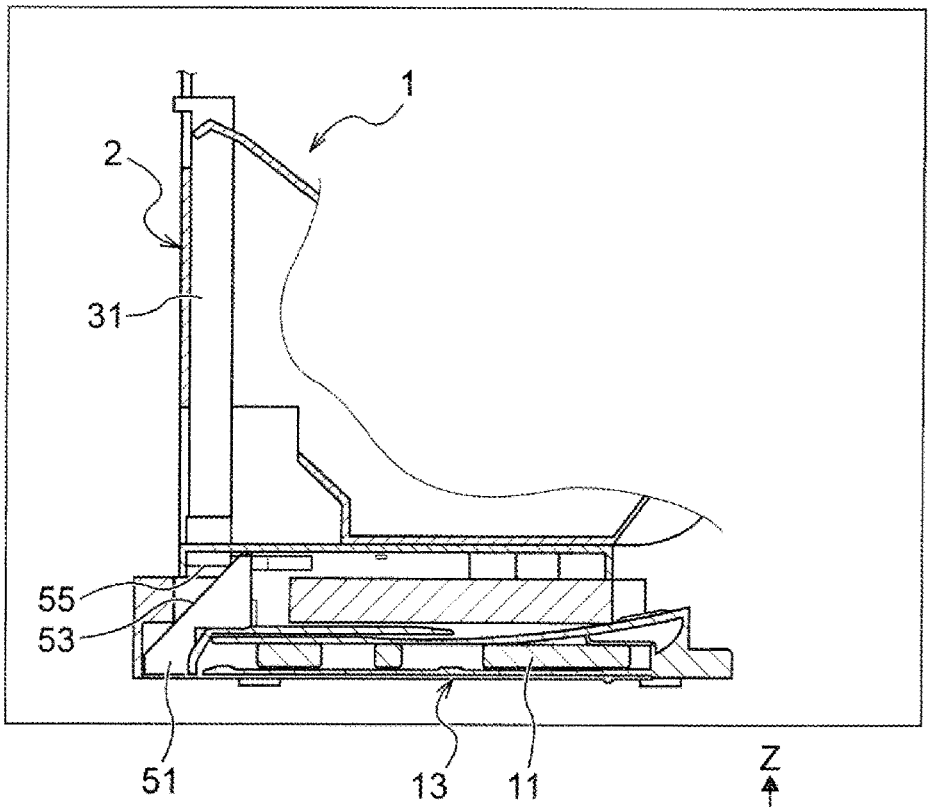
FIG. 10 is a side cross-sectional view of a main part in a second modified example of the second embodiment.

Next, another interlocking structure 3 in which the feed tray 23 and the discharge tray 11 are interlocked with each other will be described with reference to FIGS. 10A and 10B.

In the interlocking structure 3, a movement cam 51 is provided below the lever 31 so as to be movable in a front-rear direction. The movement cam 51 has an inclined surface 53. A lower portion 55 of the lever 31 is in contact with the inclined surface 53. When the lever 31 moves downward against the biasing force from the state of FIG. 10A, the movement cam 51 moves forward (+Y direction) via the inclined surface 53. In this way, as illustrated in FIG. 10B, the discharge tray 11 slides forward (+Y direction) together with the movement cam 51.

Figure 10B:
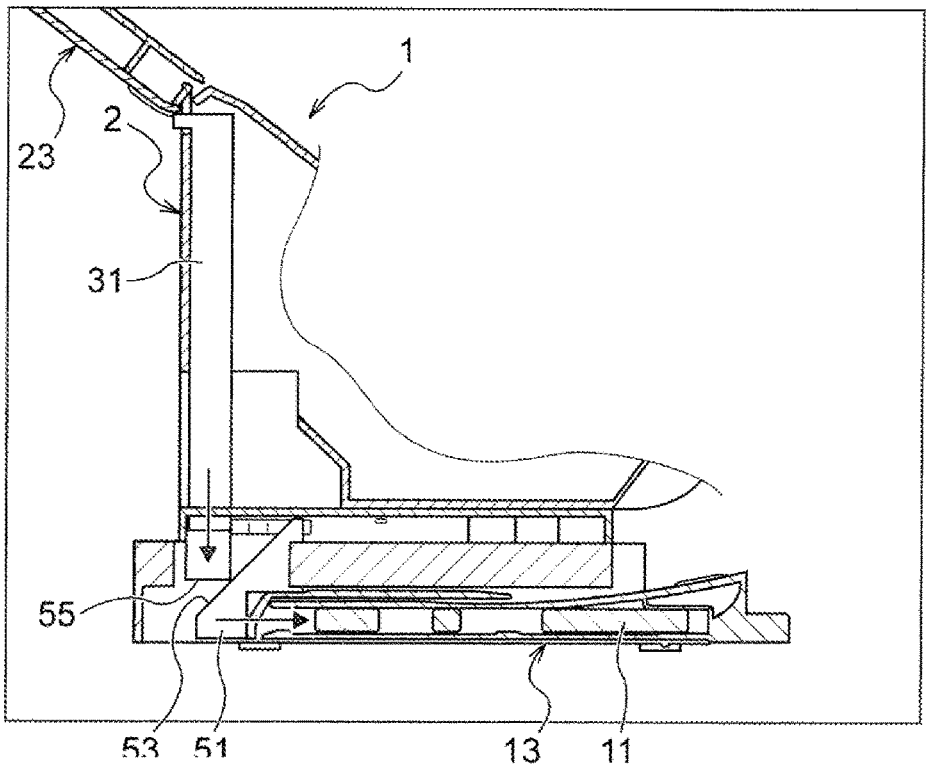

When the discharge tray 11 in the state of FIG. 10B is returned into the storage portion 21 of the placement member 13, the feed tray 23 is returned to the storage state. In this way, the lever 31 moves upward by the biasing force and stops in a position being a top dead point in FIG. 10A. In this state, when the discharge tray 11 is pushed back into the storage portion 21 of the placement member 13, the discharge tray 11 is brought into the state in FIG. 10A and held in that position.

In the description of the interlocking structure described above, the state in which the placement member 13 is directly mounted at the device main body 2 and a height adjustment member 15 is not mounted has been described. Even in a state in which the height adjustment member 15 is mounted between the device main body 2 and the placement member 13, the height adjustment member 15 can be similarly interlocked by the interlocking structure.

In this case, a length of the lever 31 can be extended and contracted, and the height adjustment member 15 is further provided with a hole through which the lever 31 passes, and thus the structure can be simplified.

OTHER EMBODIMENTS

The medium transport device 7 and the image reading apparatus 1 including the medium transport device 7 according to the present disclosure is based on the configuration of the embodiments described above. However, as a matter of course, modifications, omission, and the like may be made to a partial configuration without departing from the gist of the disclosure of the present application.

(1) In the above-described embodiment, an apparatus including the medium transport device 7 according to the present disclosure has been described as the image reading apparatus 1. However, the present disclosure is not limited to this, and can also be applied to a printing apparatus, a medium transport device, or the like.

(2) The structures of the first lock members 17, 17 and the second lock members 19, 19 are not limited to the structure in the above-described embodiment. The hooks 12, 12 may adopt a snap-fit structure to achieve a non-detachable coupling. In addition, a combination of a screw and a screw hole may be used to achieve a non-detachable coupling.

What is claimed is:

1. A medium transport device comprising:

a discharge unit provided in a device main body, wherein the discharge unit is configured to discharge a medium;

a placement member including a storage portion, wherein the placement member is configured to be attachable to and detachable from a lower portion of the device main body, the storage portion is configured to store a discharge tray, and the discharge tray is configured to slide from a storage state in which the discharge tray is stored in the storage portion into a state in which the discharge tray is configured to receive the medium discharged from the discharge unit;

a height adjustment member configured to be mountable between the placement member and the device main body;

a first lock member configured to lock coupling between the device main body and the height adjustment member; and a second lock member configured to lock coupling between the height adjustment member and the placement member, wherein the second lock member is located in the storage portion.

2. The medium transport device according to claim 1, further comprising a feed tray provided in the device main body and on which the medium to be fed is placed, wherein the feed tray is configured to open from a storage state in which the feed tray is stored in the device main body to be in a posture that enables feeding of the medium, and in a state in which the placement member is mounted downward of the device main body, the discharge tray is further configured to slide from the placement member in association with the feed tray being opened from the device main body.

3. The medium transport device according to claim 1, further comprising a second placement member configured to be attachable to and detachable from the lower portion of the device main body when the placement member is removed, wherein a second discharge tray included in the second placement member has a length in a direction in which the medium is discharged shorter than a length of the discharge tray.

4. An image reading apparatus comprising: a reading unit configured to read an image on the medium to be transported; and the medium transport device according to claim 1.

* * * * *